US006155326A

United States Patent [19]

Imhoff et al.

[11] Patent Number: 6,155,326

[45] Date of Patent: Dec. 5, 2000

[54] ROLL-UP DOORS AND CURTAINS

[75] Inventors: John C. Imhoff; David L. Kindig, both of Roanoke, Ill.

[73] Assignee: Swiss Bell Farms, Inc., Roanoke, Ill.

[21] Appl. No.: 09/288,094

[22] Filed: Apr. 7, 1999

[51] Int. Cl.[7] ..... A47G 5/02

[52] U.S. Cl. ..... 160/243; 160/310

[58] Field of Search ..... 160/242, 243, 160/246, 249, 261, 277, 310

[56] References Cited

U.S. PATENT DOCUMENTS

| | | | |
|---|---|---|---|
| 1,742,094 | 12/1929 | Perks et al. | 160/243 X |
| 3,398,779 | 8/1968 | Kuss | 160/243 |
| 3,878,879 | 4/1975 | Manns | 160/273 |
| 4,800,946 | 1/1989 | Rosenoy | 160/264 |
| 4,887,660 | 12/1989 | Kraus | 160/265 |
| 4,889,176 | 12/1989 | Nilsson | 160/264 |
| 5,680,893 | 10/1997 | Neer | 160/330 |
| 5,890,240 | 4/1999 | Graham | 160/243 X |

OTHER PUBLICATIONS

Farm Buyer's Guide—vol. 11, "Shur–lok Roll Tarp" Brochure.

"Easy–Way Roll Tarp," tct & a Industries, Division of Twin City.

Tent & Awning Company, 308 E. Anthony Drive, P.O. Box 638, Urbana, IL 61801.

*Primary Examiner*—Jerry Redman

*Attorney, Agent, or Firm*—Emrich & Dithmar

[57] ABSTRACT

An upper end of a flexible door or curtain is attached to an overhead support member while a lower portion of the curtain is disposed on and connected to an elongated horizontal tube along its length. A combination electric motor and gear box is connected to a first end of the tube for rotating the tube in a first direction for rolling the curtain onto the tube and raising the curtain and tube combination, or for rotating the tube in a second, opposed direction for unrolling the curtain from the tube and lowering the curtain and tube combination. Attached to the electric motor/gear box combination is a carriage or roller assembly which engages and rides on a generally vertical guide rail or runner during raising and lowering of the curtain. The engaging force between the roller assembly and the guide rail is adjustable to prevent binding of the curtain as it is rolled up onto or removed from the tube. A second opposed end of the tube may be either free, such as when the curtain is used indoors, or may be attached to a second generally vertical guide rail such as when the curtain is used as a door to the outside. With the curtain wound around the vertically displaced rotating tube, a continuous curtain having a large width and length can be rolled up to a retracted position or unrolled to an extended position at very high speeds using a simplified drive arrangement employing a small electric motor.

22 Claims, 3 Drawing Sheets

ROLL-UP DOORS AND CURTAINS

FIELD OF THE INVENTION

This invention relates generally to flexible structures for use as a door, curtain or partition, and is particularly directed to a overhead door, curtain or partition of the roll-up type which is lightweight, capable of high extension and retraction speeds, and may be very large in width and height.

BACKGROUND OF THE INVENTION

Roll-up doors and curtains are commonly used in various applications such as to isolate the inside of a building from the outside, separate two rooms within a structure, or prevent the contents or environment of a room from escaping from the room such as in the case of a walk-in freezer. Another use involves large removable partitions positioned so as to isolate one portion of a room such as where an item is being spray painted or cleaned using a high power water jet from other portions of the room. In these applications, the roll-up door or curtain, which hereinafter is referred to as a partition for simplicity, is mounted to an overhead cylinder which is typically rotated by an electric motor for unrolling the partition to an extended position or retracting the partition by winding it onto the tube. Opposed lower ends of the partition are connected to moving cables or are provided with a lower edge rail to keep the partition aligned with the doorway and in a stretched condition. These flexible partitions are typically comprised of a high strength plastic material such as polyvinyl chloride (PVC) and may be displaced from the open to the closed position, or visa versa, in just a few seconds. These types of partitions are generally limited in length and height by the weight of the partition itself. Counterbalancing arrangements are frequently provided to compensate for the weight of the partition, particularly when extended. Even the use of counterweight systems does not avoid the requirement to use increasingly larger electric motors and more complex support structures to accommodate large roll-up partitions. In addition, the weight of these overhead structures requires the spaced positioning of support members along the length of the overhead rotating tube. Splices are incorporated in the roll-up partition to accommodate these spaced support members along the length of the tube resulting in a partition with spaced gaps along its width. These gaps or splices limit the extent to which the partition can isolate the spaces on opposed sides of the partition from one another.

The present invention addresses the aforementioned limitations of the prior art by providing a roll-up door, curtain or partition which is of simplified construction, capable of high speed operation, can be very large in height and width, and is highly reliable and easily installed.

OBJECTS AND SUMMARY OF THE INVENTION

Accordingly, it is an object of the present invention to provide a lightweight, high speed roll-up door, curtain or partition of simplified construction.

It is another object of the present invention to provide a roll-up door, curtain or partition which is continuous and may be very large in width and height and which may be rolled-up or unrolled by means of a small electric motor and requires only a simplified support structure of few components.

Yet another object of the present invention is to compensate for changes in the torque required to unroll or roll-up an overhead roll-up door, curtain or partition to permit the use of a simplified drive arrangement employing a low power motor for even very large doors, curtains or partitions.

This invention contemplates a roll-up curtain comprising a flexible partition having upper and lower ends, wherein the flexible partition is suspended from and coupled at its upper end to a support member; an elongated, linear tube coupled to the partition adjacent to the lower end thereof; a drive arrangement coupled to an end of the tube for rotationally displacing the tube either in a first direction for raising the tube and the partition as the partition is rolled up on the tube or in a second, opposed direction for lowering the tube and the partition as the partition is unrolled from the tube, wherein the drive arrangement moves up and down with the tube; and a vertical guide coupled to the drive means for limiting upward and downward movement of the drive means and the tube in a vertical plane.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
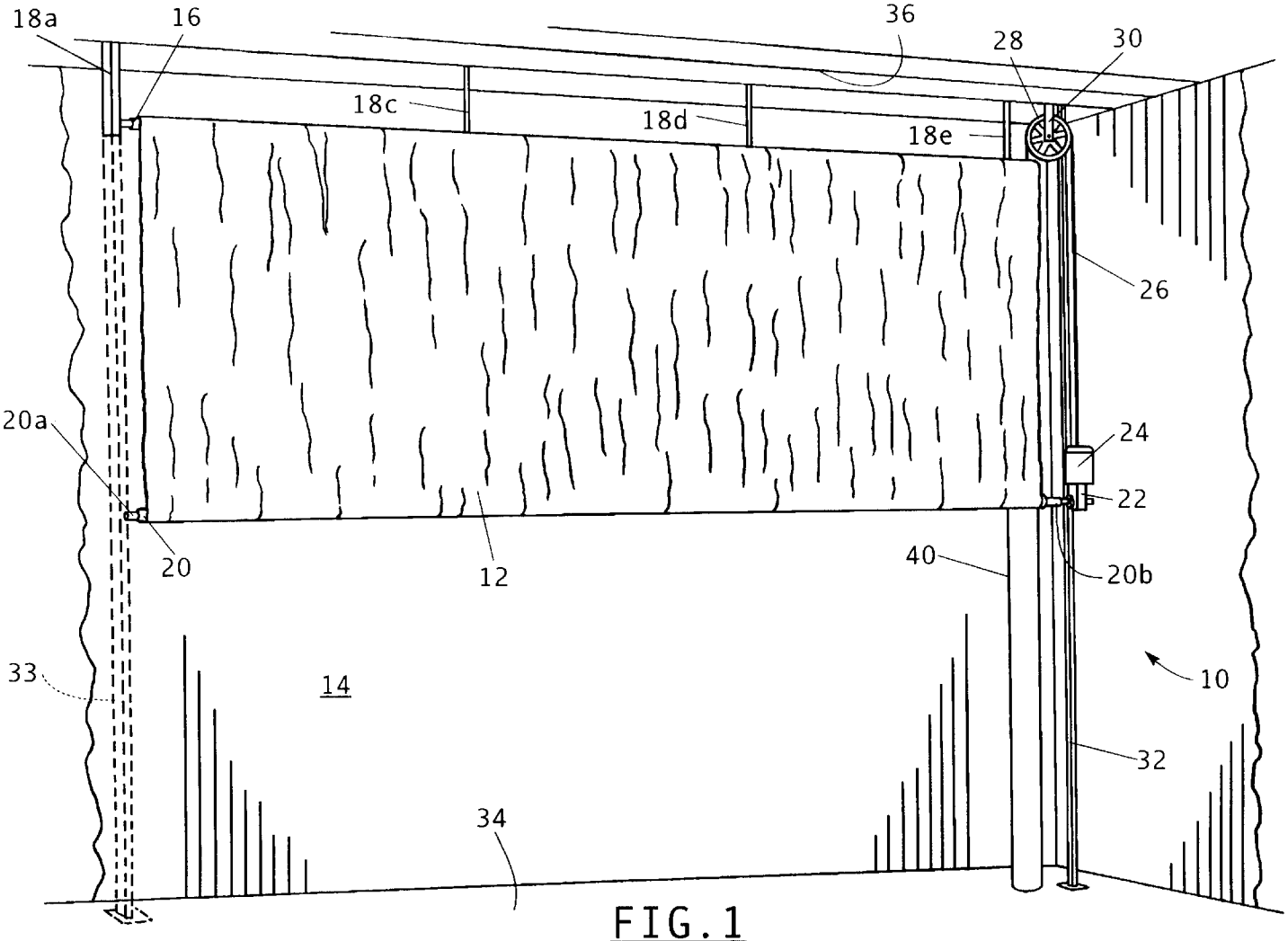
FIG. 1 is a perspective view of a roll-up curtain shown partially retracted in accordance with the principles of the present invention.
Figure 3:
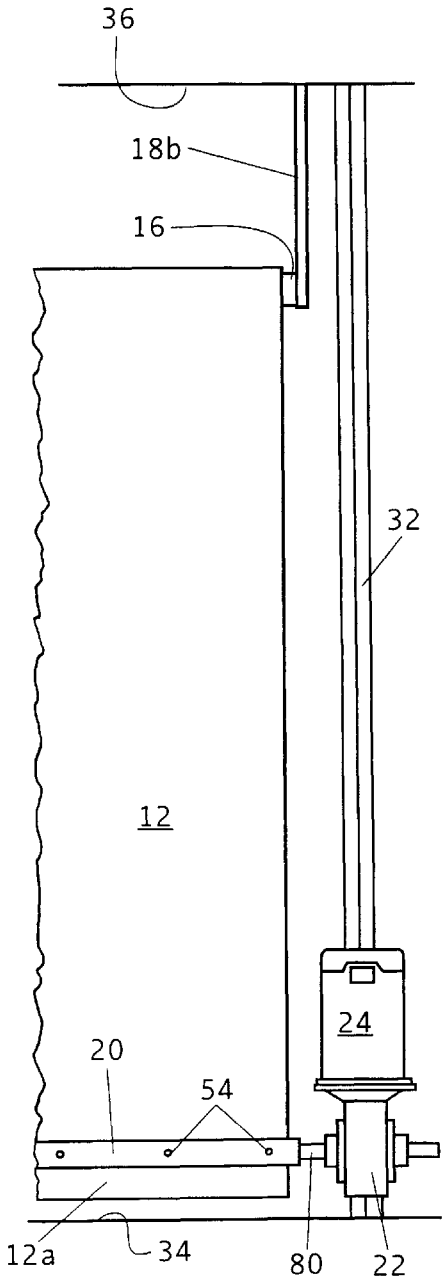
FIG. 3 is a partial plan view of the inventive roll-up curtain.

Referring to FIG. 1, there is shown a perspective view of a roll-up door or curtain 10 which includes a flexible, lightweight partition 12 attached to and suspended from a horizontal support tube 16. The support tube 16 is attached to and suspended from first and second spaced support brackets 18*a* and 18*b*, where the latter support bracket is shown in the partial front elevation view of the roll-up curtain of FIG. 3. The partition 12 is preferably comprised of a high strength plastic material such as nylon reinforced polyvinyl chloride (PVC). As shown in FIGS. 1 and 3, the first and second support brackets 18*a*,18*b* are attached to and suspended from an overhead structure such as a ceiling 36.

Additional support brackets 18*c*, 18*d* and 18*e* may be attached to ceiling 36 and support tube 16 along the length thereof in a spaced manner to provide additional support for the tube and prevent the tube from sagging.

Figure 2:
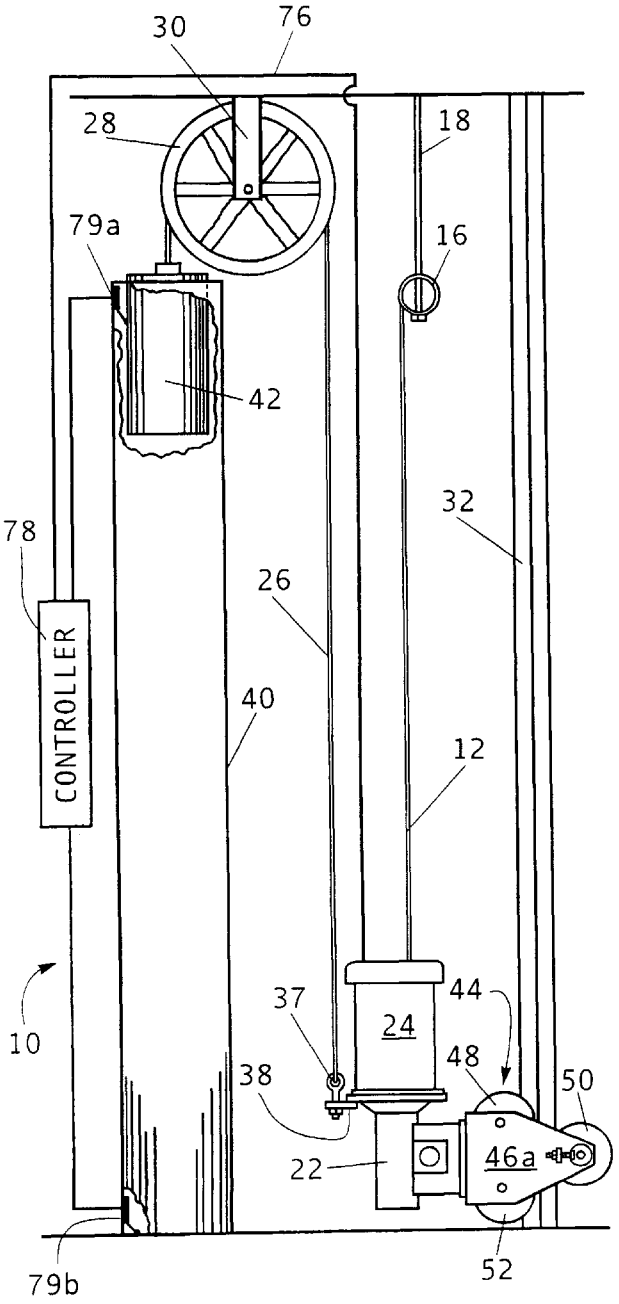
FIG. 2 is a partially cut-away side elevation view of the roll-up curtain of the present invention.
Figure 6:
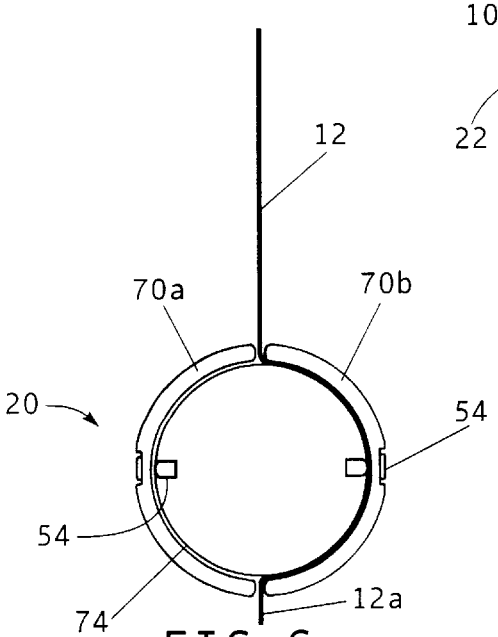
FIG. 6 is a sectional view of a roll-up curtain attached to a rotating tube in accordance with the present invention.

With reference also to FIG. 2, which is a side elevation view of the roll-up curtain 10, additional details of the invention will now be described. Attached to a lower portion of the partition 12 is a roll-up tube 20 as shown in the sectional view of FIG. 6. The roll-up tube 20 includes an inner elongated, linear steel tube 74. Attached to the inner steel tube 74 on opposed outer portions thereof and extending the length of the tube are first and second outer half sleeves 70*a* and 70*b*. Each of the first and second outer half sleeves 70*a*,70*b* is preferably comprised of PVC and is attached to the inner steel tube 74 by a plurality of spaced coupling pins 54. Coupling pins 54 may be either screws or rivets and securely attach the first and second outer half sleeves 70*a*,70*b* to the inner steel tube 74 along their respective lengths. The partition 12 is disposed between one-half portion of the inner steel tube 74 and the second outer half sleeve 70*b* in a tight-fitting manner. The coupling pins 54 are inserted through the partition 12 in a spaced manner along its entire width. An end portion 12*a* of the partition 12 extends beyond and is positioned below the roll-up tube 20 when the partition 12 is fully unrolled, or extended. When the roll-up tube 20 is rotationally displaced in a first direction, the partition 12 is tightly wound around the outer surfaces of the first and second outer half sleeves 70*a* and 70*b*. When the rollup tube 20 is rotationally displaced in a second, opposed direction, the partition 12 is unwound, or let off, from the roll-up tube and the partition is lowered as described below. The weight of the roll-up tube 20 maintains the unrolled partition in a stretched condition.

Figure 7:
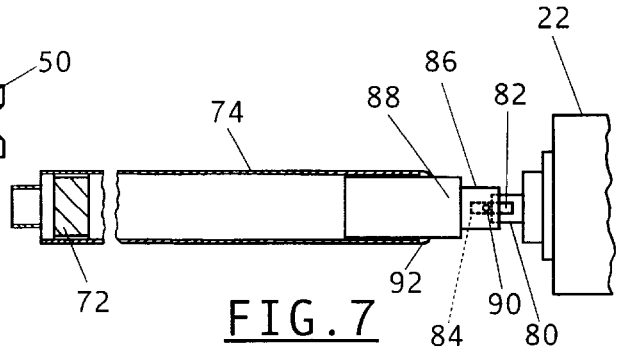
FIG. 7 is a partial sectional view shown partially in phantom of the connection between a roll-up tube and a transmission assembly or gear box in accordance with another aspect of the present invention.
Figure 8:
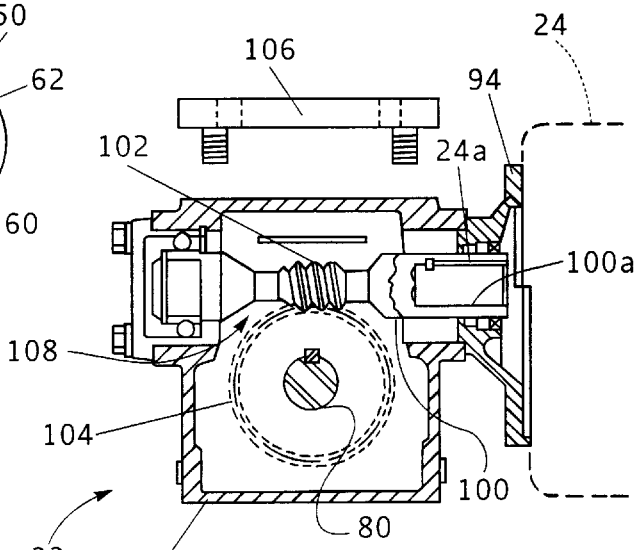
FIG. 8 is a sectional view of the gear box used in the present invention for connecting an electric motor to the rotating roll-up tube on which the curtain is disposed.
Figure 9:
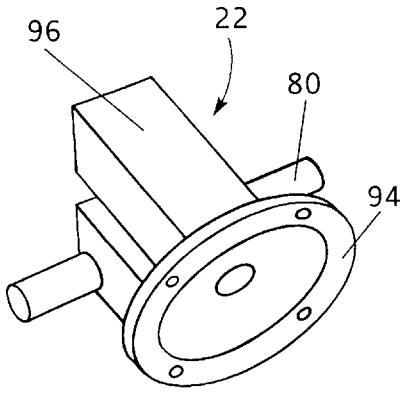
FIG. 9 is a perspective view of the gear box shown in FIG. 8.

Attached to one end of the roll-up tube 20 is the combination of an electric motor 24 and a gear box, or transmission assembly, 22. Sectional and perspective views of the gear box 22 are respectively shown in FIGS. 8 and 9. Details of the connection between the gear box 22 and the inner steel tube 74 of the roll-up tube 20 are shown in FIG. 7. Gear box 22 includes a generally circular mounting flange 94 and a housing 96. Mounting flange 94 is adapted for attachment to the electric motor 24 (shown in FIG. 8 in dotted line form) by means of a plurality of mounting bolts (which are not shown in the figures for simplicity). Disposed within the gear box's housing 96 is an input shaft 100 which includes a slotted end portion 100*a* for receiving an output shaft 24*a* of the electric motor 24. Rotation of the electric motor's output shaft 24*a* causes a corresponding rotation of the gear box's input shaft 100. Disposed on the input shaft 100 is a threaded portion 102. Also disposed within the gear box's housing 96 is an output shaft 80 oriented transversely to the input shaft 100. The output shaft 80 extends out of the gear box housing 96 as shown in FIG. 9 and includes a threaded portion 104 which engages the threaded portion 102 of the input shaft 100. The threaded portions 102,104 of the gear box input shaft 100 and output shaft 80 form a worm gear 108 for converting rotational displacement of the electric motor's output shaft 24*a* to a corresponding rotational displacement of the gear box's output shaft 80. The gear box 22 includes various bearings and seals as is conventional, which are not described here for the sake of brevity.

Inserted in an open end of the roll-up tube's inner steel tube 74 is a solid steel shaft 88 as shown in the sectional view of FIG. 7. The solid steel shaft 88 is securely attached to the end of the roll-up tube's inner steel tube 74 by conventional means such as a weldment 92. A bushing 86 is welded to the outer end of the solid steel shaft 88 and includes an elongated slot 84 (shown in dotted line form in FIG. 7) in an end thereof. The outer end of the bushing 86 further includes a recessed portion for receiving an end of the electric motor's output shaft 80 in a tightfitting manner. The end of the electric motor's output shaft 80 is also provided with a slot therein. Inserted in the facing, aligned slots of the bushing 86 and the electric motor's output shaft 80 is a key 82 for connecting the electric motor's output shaft and the roll-up tube's inner steel tube 74. Rotation of the electric motor's output shaft 80 causes a corresponding rotation of the roll-up tube's inner steel tube 74. A set screw 90 threadably inserted in an aperture in bushing 86 maintains the key 82 within the bushing. A corresponding coupling arrangement for securely attaching the key 82 to the electric motor's output shaft 80 may also be provided, although this is not shown in the figure for simplicity. Also as shown in FIG. 7, the inner steel tube 74 is provided with a counterweight 72 adjacent its end away from the electric motor and gear box combination to compensate for the weight of the electric motor 24, gear box 22 and a roller assembly 44 so that the inner steel tube remains horizontal during raising and lowering of the curtain.

Figure 4:
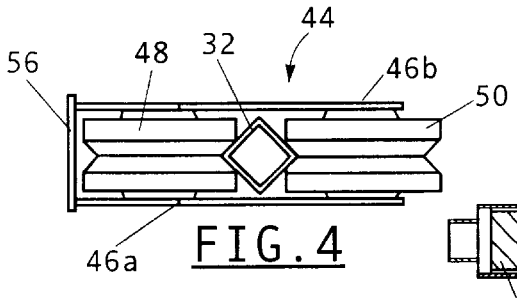
FIG. 4 is a top plan view of a roller assembly or carriage used in the roll-up door of the present invention.
Figure 5:
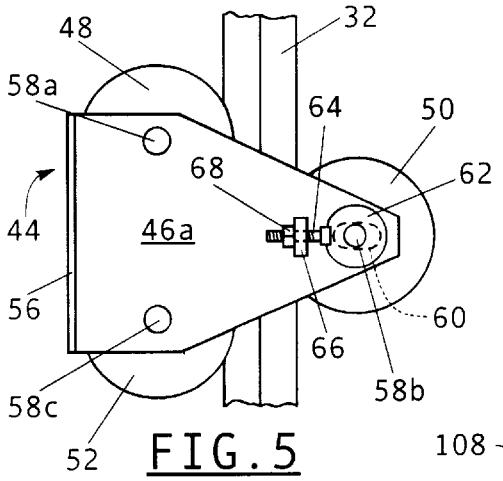
FIG. 5 is a side elevation view of the roller assembly shown in FIG. 4.

Also attached to gear box 22 is the carriage or roller assembly 44. An adapter bracket 106 shown in FIG. 8 may be used to facilitate mounting the roller assembly 44 to the gear box's housing 96 by conventional means such as bolts. Top plan and side elevation views of the roller assembly 44 are respectively shown in FIGS. 4 and 5. Roller assembly 44 includes first and second spaced side plates 46*a* and 46*b* coupled together by means of a connecting plate 56 attached to adjacent edges of the first and second side plates. Disposed between and coupled to the first and second side plates 46*a*,46*b* are first, second and third rollers 48, 50 and 52. The first, second and third rollers 48, 50 and 52 are respectively positioned on and coupled to the first and second side plates 46*a*,46*b* by means of first, second and third pivot pins 58*a*, 58*b* and 58*c*. The first and third rollers 48 and 52 are in generally vertical alignment, with the second roller 50 horizontally offset from the first and second rollers. Each of the rollers includes a center recessed portion extending around the periphery thereof permitting each of the rollers to engage an outer corner of a vertical runner or guide rail 32 having a generally rectangular or a square cross section as shown in FIG. 4. The first and third rollers 48,52 are positioned in engagement with a first corner of the vertical guide rail 32, while the second roller 50 is positioned in intimate contact with a second, opposed corner of the guide rail. The vertical guide rail 32 maintains the roll-up tube 20 in vertical alignment with the upper support tube 16 and thus ensures vertical displacement of the roll-up tube 20 during raising and lowering of the curtain. With one end 20*b* of the roll-up tube 20 connected to the gear box 22 and electric motor 24 combination, a second end 24*a* of the roll-up tube may be connected to a second vertical runner 33 which is shown in FIG. 1 in dotted line form. The second vertical runner 33 is not necessary for operation of the roll-up curtain 10, but may be desired when the partition 12 is subject to movement such as by wind or other forms of moving air or changing pressures.

Fixedly attached to the outer surface of the first side plate 46*a* of the roller assembly 44 is a bracket 66. Inserted through bracket 66 is a bolt 64 which is attached to a washer 62. Washer 62 includes a circular aperture through which is inserted the second pivot pin 58*b* which rotatably supports the second roller 50. Disposed within the first side plate 46*a* is an elongated slot 60 shown in FIG. 5 in dotted line form. An adjusting nut 68 is positioned on bolt 64 and engages bracket 66. By means of adjusting nut 68, the second pivot pin 58*b* and second roller 50 combination may be moved toward the first and third rollers 48,52 to more securely engage the vertical guide rail 32. In this manner, the frictional force between the three rollers 48, 50 and 52 and the vertical guide rail 32 may be adjusted as required to provide the moving roll-up tube 20 with a certain amount of inertia and prevent binding of the partition 12.

Connected to the electric motor 24 by means of a combination of a threaded connecting pin 37 with an eyelet and a connecting bracket 38 is a cable 26 as shown in FIG. 2. Cable 26 is preferably comprised of a high strength steel and is routed over a pulley 28 which is suspended from the ceiling 36 by means of a support bracket 30 as shown in FIG. 1. A second opposed end of the cable 26 is coupled to a counterweight 42 which is disposed within an elongated, linear guide tube 40. Cable 26 is linearly displaced and pulley 28 is rotationally displaced as the partition 12 is raised or lowered. Counterweight 42 takes weight off of the partition 12 by compensating for the weight of the combination of gear box 22, electric motor 24, and roller assembly 44 in the raising and lowering of the partition 12. Counterweight 42 also reduces the power required to raise the roll-up tube and retract the roll-up curtain 10. Also connected to the electric motor 24 by means of an electrical lead 76 is a controller 78 for controlling the operation of the electric motor. Controller 78 is responsive to operator inputs for raising and lowering the roll-up curtain 10. Controller 78 is further coupled to lower and upper limit switches 79*a* and 79*b* which are triggered by engagement with the counterweight 42. The lower limit switch 79*a* provides a signal to the controller 78 for stopping downward displacement of the rollup tube 20 when the partition 12 is in the fold-down position. Similarly, upper limit switch 79*b* provides an appropriate signal to the controller 78 for stopping further upward movement of the roll-up tube 20 when the partition 12 is fully retracted, or upraised. It should be noted here that the partition 12 and electric motor 24 and gear box 22 combination may be positioned either between the counterweight guide tube 40 and the vertical guide rail 32 as shown in FIG. 2 or the partition and electric motor and gear box combination may be positioned in front of both the counterweight guide tube and vertical guide rail as shown in FIG. 1.

There has thus been shown a flexible door or curtain having an upper end attached to and suspended from an overhead support member. Attached to the curtain adjacent its lower end is an elongated, linear roll-up tube which extends the full width of the curtain. Attached to one end of the tube is the combination of an electric motor and a gear box for rotationally displacing the tube. Rotation of the tube in a first direction causes the curtain to be wound around the tube and to be displaced upwardly toward a retracted position. Rotation of the tube in a second, opposed direction unwinds the curtain from the tube and lowers the bottom edge of the curtain toward the fully extended position. A counterweight is attached by means of a cable and pulley arrangement to the motor to compensate for the weight of the motor and gear box combination as well as that of the roll-up tube. The motor and gear box combination is connected by means of a roller assembly to a vertical runner or guide rail for ensuring vertical movement of the roll-up tube as the curtain is retracted and wound onto the tube or is extended as it is unwound from the tube. Frictional engagement of the roller assembly with the vertical guide rail is adjustable to maintain the curtain in a stretched condition and to prevent binding of the curtain as it is rolled-up onto or unrolled from the tube. Upper and lower limit switches limit the vertical displacement of the roll-up tube with the curtain in the full up (open) or full down (closed) positions, respectively. The lightweight and simplicity in design of the invention allows curtains having very large heights and widths to be rolled up and unrolled at very high speeds using a small electric motor and a simplified installation.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

I claim:

1. A roll-up curtain comprising:

a flexible partition having upper and lower ends, wherein said flexible partition is suspended from and coupled at its upper end to a support member;

an elongated, linear tube coupled to said partition adjacent to the lower end thereof;

drive means including a motor coupled to an end of said tube for rotationally displacing said tube either in a first direction for raising said tube and said partition as said partition is rolled up on said tube or in a second, opposed direction for lowering said tube and said partition as said partition is unrolled from said tube, wherein said motor moves up and down with said tube; and first vertical guide means coupled to said drive means for limiting upward and downward movement of said drive means and said tube in a vertical plane.

2. The roll-up curtain of claim 1 wherein said partition is comprised of nylon reinforced polyvinyl chloride.

3. The roll-up curtain of claim 1 wherein said tube includes an inner tube and first and second outer half sleeves attached to said inner tube and extending the length thereof, wherein said partition is disposed between and engaged by said inner tube and said second outer half sleeve in a tight-fitting manner.

4. The roll-up curtain of claim 3 wherein each of said first and second outer half sleeves subtends an arc of approximately 180° about the outer periphery of said inner tube.

5. The roll-up curtain of claim 4 wherein said inner tube is comprised of steel and said outer half sleeves are each comprised of polyvinyl chloride.

6. The roll-up door of claim 5 further comprising coupling pins disposed along the lengths of said inner tube and each of said outer half sleeves in a spaced manner for connecting each of said outer half sleeves to said inner tube.

7. The roll-up door of claim 1 further comprising a counterweight coupled to said drive means to compensate for the weight of said drive means.

8. The roll-up door of claim 7 further comprising a cable and pulley combination coupling said counterweight to said drive means.

9. The roll-up door of claim 8 further comprising vertical guide means disposed adjacent said counterweight for limiting displacement of said counterweight to a vertical direction.

10. The roll-up door of claim 9 further comprising a controller coupled to said drive means and responsive to operator inputs for raising and lowering said partition.

11. The roll-up door of claim 10 further comprising upper and lower limit switches coupled to said controller for limiting upward and downward displacement of said partition in opening and closing the curtain.

12. The roll-up door of claim 11 wherein said upper and lower limit switches are triggered by said counterweight when in a full down or in a full up position, respectively.

13. The roll-up door of claim 1 wherein said first vertical guide means includes a generally vertical guide rail and a roller assembly coupled to said drive means and disposed on said guide rail.

14. The roll-up door of claim 13 wherein said roller assembly includes first and second rollers engaging opposed edges of said guide rail and means for changing a frictional force between said rollers and said guide rail.

15. The roll-up door of claim 1 further comprising a controller coupled to said drive means and responsive to operator inputs for raising and lowering said partition.

16. The roll-up door of claim 15 further comprising means for limiting upward and downward displacement of said partition when the curtain is respectively in the full up and full down positions.

17. The roll-up door of claim 16 wherein said means for limiting upward and downward displacement of said partition includes upper and lower limit switches coupled to said controller.

18. The roll-up curtain of claim 1 wherein said tube includes first and second opposed ends and wherein said drive means is coupled to the first end of said tube, said roll-up curtain further comprising a weight disposed on or in said tube adjacent its second end to compensate for the weight of said drive means.

19. The roll-up curtain of claim 1 wherein said tube includes first and second opposed ends and wherein said drive means is coupled to the first end of said tube, said roll-up curtain further comprising second vertical guide means coupled to the second end of said tube for limiting movement of said tube in a vertical plane.

20. The roll-up curtain of claim 19 wherein said second vertical guide means is a vertical runner engaging the second end of said tube.

21. The roll-up curtain of claim 1 further comprising a plurality of support brackets coupled to said support member in a spaced manner along the length thereof.

22. The roll-up curtain of claim 21 wherein said support member comprises an elongated, linear member disposed above said tube.

* * * * *